US006966824B2

(12) United States Patent
Kötting et al.

(10) Patent No.: US 6,966,824 B2
(45) Date of Patent: Nov. 22, 2005

(54) ARRANGEMENT FOR DETACHABLY SECURING A GRINDING WHEEL OR A GROUP OF GRINDING WHEELS ON A WHEEL SPINDLE

(75) Inventors: Fritz Kötting, Dormagen (DE); Ansgar Schmitz, Willich (DE)

(73) Assignee: Weco Optik GmbH (DE)

( * ) Notice: Subject to any disclaimer, the term of this patent is extended or adjusted under 35 U.S.C. 154(b) by 0 days.

(21) Appl. No.: 10/451,648

(22) PCT Filed: Nov. 30, 2001

(86) PCT No.: PCT/EP01/14002

§ 371 (c)(1),
(2), (4) Date: Sep. 2, 2003

(87) PCT Pub. No.: WO02/051588

PCT Pub. Date: Jul. 4, 2002

(65) Prior Publication Data

US 2004/0063389 A1 Apr. 1, 2004

(30) Foreign Application Priority Data

Dec. 22, 2000 (DE) ..... 100 64 163

(51) Int. Cl.[7] ..... B24B 45/00
(52) U.S. Cl. ..... 451/177; 451/342
(58) Field of Search ..... 451/177, 342, 451/344, 359

(56) References Cited

U.S. PATENT DOCUMENTS

| | | | | | |
|---|---|---|---|---|---|
| 2,244,057 | A | * | 6/1941 | Ekholm | 451/342 |
| 3,269,271 | A | | 8/1966 | Bruckner | |
| 3,894,361 | A | | 7/1975 | Georgiadis et al. | 51/101 |
| 5,022,188 | A | * | 6/1991 | Borst | 451/342 |
| 5,042,207 | A | * | 8/1991 | Kirn | 451/342 |
| 5,058,909 | A | * | 10/1991 | Rudolf et al. | 279/8 |
| 5,157,873 | A | * | 10/1992 | Rudolf et al. | 451/342 |
| 5,163,250 | A | * | 11/1992 | Weber | 451/342 |
| 5,319,886 | A | * | 6/1994 | Steere, Jr. | 451/342 |
| 5,545,078 | A | * | 8/1996 | Schulz et al. | 451/342 |
| 5,601,483 | A | * | 2/1997 | Rudolf et al. | 451/359 |
| 5,651,726 | A | * | 7/1997 | Skogsberg | 451/342 |
| 5,658,192 | A | * | 8/1997 | Reinauer | 451/342 |
| 5,718,621 | A | | 2/1998 | Turley | 451/342 |

FOREIGN PATENT DOCUMENTS

| | | |
|---|---|---|
| DE | 4200365 | 7/1993 |
| DE | 19527222 | 1/1997 |
| EP | 0147545 | 7/1985 |
| EP | 0274276 | 7/1988 |
| EP | 0366105 | 5/1990 |
| GB | 2071567 | 9/1981 |

OTHER PUBLICATIONS

German Search Report dated May 28, 2001.
International Search Report dated Apr. 4, 2002.

* cited by examiner

*Primary Examiner*—David B. Thomas
(74) *Attorney, Agent, or Firm*—Ostrolenk, Faber, Gerb & Soffen, LLP

(57) ABSTRACT

Arrangement for releasably fastening a grinding wheel or a group of grinding wheels on a wheel spindle, for example, a group of grinding wheels in a spectacle-lens-edging machine. The machine has a grinding-wheel-retaining shaft that is arranged, in an axially displaceable manner, in a coaxial bore of the wheel spindle, a retaining disk that may be fastened in a releasable manner at the free end of the grinding-wheel-retaining shaft, and clamping elements arranged between the wheel spindle and the grinding-wheel-retaining shaft for axially bracing and releasing the grinding wheel or the group of grinding wheels between the wheel spindle and the retaining disk.

6 Claims, 3 Drawing Sheets

ARRANGEMENT FOR DETACHABLY SECURING A GRINDING WHEEL OR A GROUP OF GRINDING WHEELS ON A WHEEL SPINDLE

FIELD OF THE INVENTION

The invention relates to an arrangement for releasably securing a grinding wheel or a group of grinding wheels on a wheel spindle, for example, a wheel spindle in a spectacle-lens-edging machine, as referred to in commonly owned German Published Patent Application No. 195 27 222.

BACKGROUND INFORMATION

Grinding wheels or groups of grinding wheels may be releaseably secured on a wheel spindle to permit them to be exchanged if, for example, they become worn or if, in respect of different machining operations, they are to be exchanged.

Grinding wheels for spectacle-lens-edging machines may be provided with a cylindrical region and a grooved region. The cylindrical region may be used to pre-machine a spectacle lens to shape and the grooved region may be used to form a bevel on the circumference of the shaped spectacle lens. More than one grinding wheel may be used, for example, three grinding wheels, of which one grinding wheel may be provided for machining plastic lenses, a cylindrical grinding wheel may be provided for the rough grinding of spectacle lenses made of silicate glass and a grinding wheel with a bevel groove may be provided for precision or fine machining and beveling.

The wheel spindle and the grinding wheels are arranged on the spectacle-lens-edging machine in a grinding chamber, which may be closed on all sides to prevent abraded material produced during grinding and a cooling lubricant from passing to the outside. The cooling lubricant may be sprayed into the grinding region between the grinding wheel and the spectacle lens. Although the grinding chamber is kept as small as possible, a spray guard may be arranged tightly around the grinding wheels, said spray guard only leaving the grinding region exposed and having contact shoe regions, on which the unmachined lens and/or the ground-to-shape spectacle lens is positioned to be measured.

The grinding chamber may define a confined space, which may make it very difficult to exchange grinding wheels or groups of grinding wheels, since the grinding wheels are connected to the wheel spindle such that a grinding-wheel-retaining shaft, which is connected integrally to the wheel spindle and has a smaller diameter than the wheel spindle, has a sleeve having a length smaller than the width of the grinding wheel(s). The sleeve bears the grinding wheels and centers them, while a retaining disk braces the wheel spindle, the retaining disk having a greater diameter than the diameter of the sleeve. The retaining disk may be screwed to the grinding-wheel-retaining shaft to brace the grinding wheel with the wheel spindle.

To remove the grinding wheels, the grinding chamber must have enough space sufficient to permit the grinding wheels to be withdrawn from the grinding-wheel-retaining shaft and the grinding chamber, individually or together.

Furthermore, the grinding chamber must have enough space sufficient to permit a suitable wrench to attach to a screw connection of the retaining disk to clamp and release the connection. Finally, a double tolerance is provided between the grinding-wheel-retaining shaft and the sleeve and the sleeve and the grinding wheel or the group of grinding wheels, said double tolerance adversely affecting the concentric-running properties.

If the initially mentioned spray guard with the contact shoes is present, the guard may need to be removed before the grinding wheel(s) is removed.

In the case of prior art spectacle-lens-edging machines, the task of exchanging a grinding wheel or a group of grinding wheels is thus time-intensive and requires a certain amount of skill.

SUMMARY OF THE INVENTION

An object of the present invention is to facilitate the installation and the removal of grinding wheels or groups of grinding wheels on wheel spindles with confined space conditions in the axial direction. Another object of the present invention is to help ensure improved concentric-running properties.

In one exemplary embodiment according to the present invention, an arrangement is provided to releasably secure a grinding wheel or a group of grinding wheels on a wheel spindle, for example, on a wheel spindle of a spectacle-lens-edging machine. The grinding-wheel-retaining shaft is arranged in an axially displaceable manner in a coaxial bore of the wheel spindle with a close fit. The grinding-wheel-retaining shaft may be retracted into the wheel spindle by at least the width of a grinding wheel, on which a grinding wheel(s) is seated directly and without play. The free end of the grinding-wheel-retaining shaft may be provided with a retaining disk to secure clamping elements between the wheel spindle and the grinding-wheel-retaining shaft in a releasable manner. This helps ensure the axial bracing and release of the grinding wheel(s) between the wheel spindle and the retaining disk and also the retraction of the grinding-wheel-retaining shaft into the wheel spindle by at least the width of a grinding wheel.

In accordance with another exemplary embodiment of the present invention, the grinding wheel(s) is seated directly and without play on the grinding-wheel-retaining shaft, without the prior-art double tolerance being provided between the grinding-wheel-retaining shaft and the sleeve.

To exchange a grinding wheel or a group of grinding wheels, the grinding-wheel-retaining shaft is displaced in the direction of the grinding wheel(s) to release the bracing of the grinding wheel(s) between the wheel spindle and the retaining disk. In this manner, the retaining disk may be removed from the grinding-wheel-retaining shaft without the aid of a tool. Thereafter, the grinding-wheel-retaining shaft is displaced in the opposite direction within the wheel spindle so that its free end completely frees the grinding wheel, or at least one grinding wheel of a group of grinding wheels. In this manner, the grinding wheel(s) may be removed from the grinding chamber without axial displacement from the region of the wheel spindle. To insert a grinding wheel(s), the procedure described above may be performed in reverse. The new grinding wheel(s) is positioned in the region of the wheel spindle in the grinding chamber when the grinding-wheel-retaining shaft has been retracted. Then, the grinding-wheel-retaining shaft is extended out of the wheel spindle, and guided through the accommodating bore in the grinding wheel(s). Next, the retaining disk is secured to the free end of the grinding-wheel-retaining shaft. Then, the grinding-wheel-retaining shaft is moved in the opposite direction to brace the grinding wheel or the group of grinding wheels between the wheel spindle and the retaining disk.

The retaining disk may be screwed to the free end of the grinding-wheel-retaining shaft, for example, using a through-bolt or threaded pin connected to the retaining disk. In this manner, a special tool would not be required to release the screw connection because the bracing of the grinding wheel(s) between the wheel spindle and the retaining disk occurs by axial displacement of the grinding-wheel-retaining shaft, and the screw connection of the retaining disk may be rotated freely once the bracing has been eliminated.

In accordance with another exemplary embodiment of the present invention, the retaining disk is connected to the free end of the grinding-wheel-retaining shaft as a bayonet connection. In this manner, the retaining disk may be released from the grinding-wheel-retaining shaft without the aid of a tool, release not being possible in the braced state.

The clamping elements between the wheel spindle and the grinding-wheel-retaining shaft may comprise a threaded connection between the grinding-wheel-retaining shaft and the wheel spindle. For this purpose, the externally threaded grinding-wheel-retaining shaft may be screwed directly into a threaded bore in the wheel spindle. Alternatively, the grinding-wheel-retaining shaft may be provided with a threaded bore for a headed bolt, which may be supported on the wheel spindle via a flanged bushing.

The grinding-wheel-retaining shaft screwed into the wheel spindle may be manually rotated in the bore of the wheel spindle using a suitable handle. A tool may be provided to tighten the handle. For example, if a headed bolt is used to displace and brace the grinding-wheel-retaining shaft, a hexagon-socket wrench may be used.

To speed up the screwing and unscrewing of the grinding-wheel-retaining shaft in the bore of the wheel spindle or the headed bolt, and to be able to dispense with clamping tools, for example, an electric rotary drive may be arranged between the wheel spindle and the grinding-wheel-retaining shaft or the headed bolt.

A hydraulic or pneumatic piston/cylinder unit may be provided as a clamping element between the grinding-wheel-retaining shaft and the wheel spindle, said unit providing the bracing and allowing the quick axial displacement of the grinding-wheel-retaining shaft in the bore of the wheel spindle. This arrangement permits a quick actuation.

DETAILED DESCRIPTION

Figure 1:
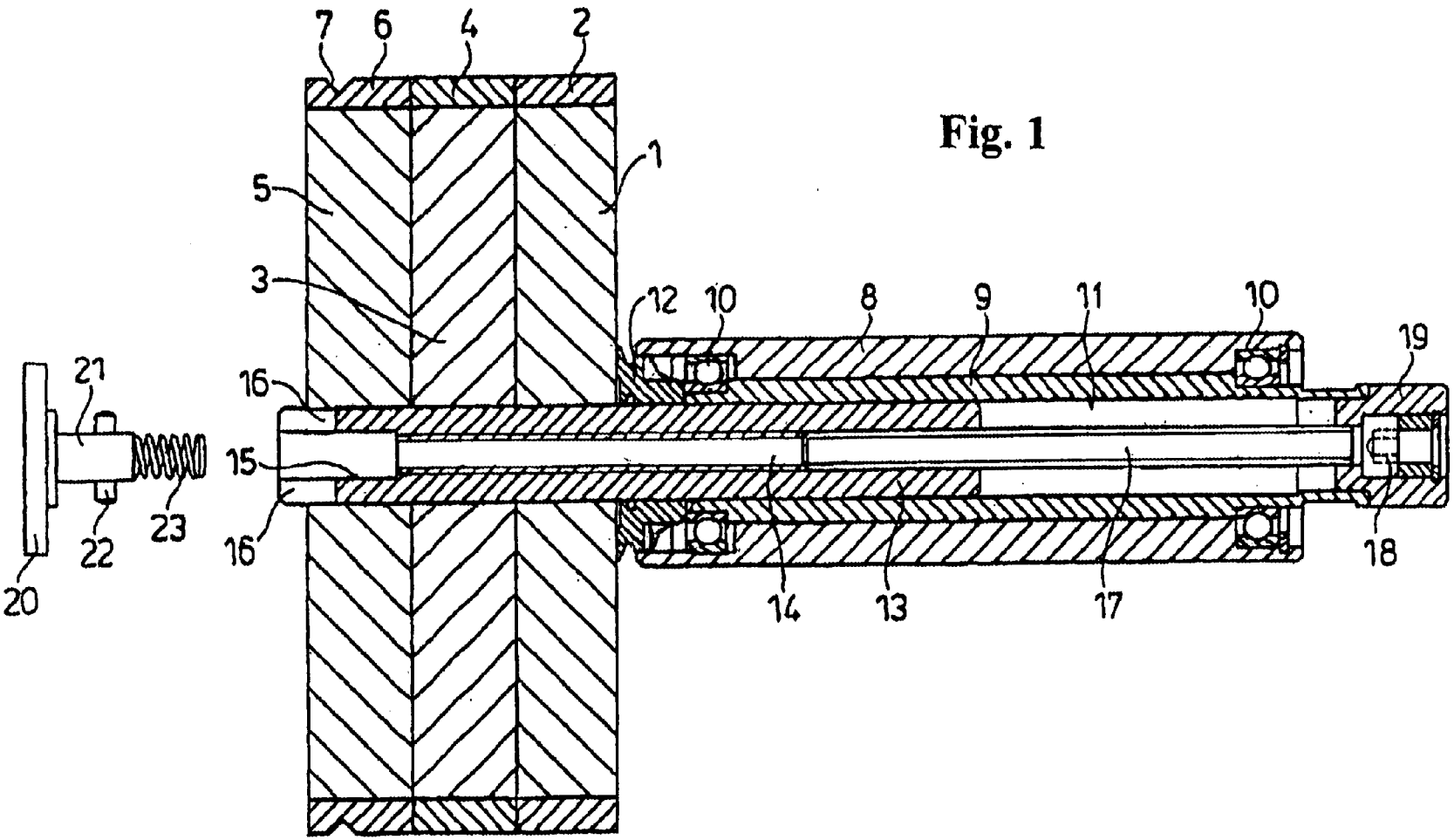
FIG. 1 shows part of a spectacle-lens-edging machine in cross section, with a group of grinding wheels on a wheel spindle.

Of the spectacle-lens-edging machine, only a housing neck 8, in which a wheel spindle 9 is mounted by means of a pair of rolling-contact bearings 10, is illustrated.

A group of grinding wheels, comprising a grinding wheel 1 for plastic, with a metal ring 2 in which diamond abrasive materials have been metalically bound, a rough-grinding wheel for silicate glass, with a metal ring 4 in which diamond abrasive materials have been metalically bound, and a precision-grinding wheel 5, with a ring 6 which is of the same design and has a bevel groove 7 for forming a ridge bevel on the circumference of a ground-to-shape spectacle lens, are seated on a grinding-wheel-retaining shaft 13, which has been introduced with a close fit into a bore 11 of the wheel spindle 9. The grinding-wheel-retaining shaft 13 has a threaded bore 14 and a cylindrical bore 15, which is coaxial with the threaded bore and has a larger diameter. At the free end, diametrically opposite, angled slots 16 for a bayonet securing arrangement (described below) are provided in the grinding-wheel-retaining shaft 13.

A headed bolt 17 with a hexagon-socket head 18 is screwed into the threaded bore 14. The head 18 is supported on the wheel spindle 9 by a flanged bushing 19, the flanged bushing 19 being adhesively bonded within the wheel spindle 9.

To brace the group of grinding wheels 1, 3, 5 with the wheel spindle 9, a retaining disk 20 is inserted into the bore 15 via cylindrical extension 21, on which radial studs 22 are located, such that the radial studs 22 and the cylindrical extension 21 pass into the angled slots 16 and, by virtue of rotation, form the bayonet connection. A compression spring 23 is supported between the cylindrical extension 21 and a shoulder at the end of the bore 15 in the grinding-wheel-retaining shaft 13. If the headed bolt 17 is then rotated to retract the grinding-wheel-retaining shaft 13 into the bore 11 of the wheel spindle 9, the retaining disk 20 abuts against the group of grinding wheels 1, 3, 5 and braces the grinding wheels 1, 3, 5 with the wheel spindle 9 via a supporting disk 12.

To release the group of grinding wheels 1, 3, 5, the headed bolt 17 is rotated in the opposite direction until it reaches the position illustrated in the figure. The retaining disk 20 may then be easily removed. If the headed bolt 17 is rotated again in the direction for clamping, the grinding-wheel-retaining shaft 13 is retracted into the wheel spindle 9 so that the end of the grinding-wheel-retaining shaft 13 is guided out of the accommodating bore of the grinding wheel 5. In this manner, the group of grinding wheels 1, 3, 5 may be removed radially from the region of the grinding-wheel-retaining shaft 13.

The grinding-wheel-retaining shaft 13 may also be retracted into the wheel spindle 9 so that the entire group of grinding wheels 1, 3, 5 may be removed in the radial direction.

The procedure may be performed in reverse to insert a group of grinding wheels 1, 3, 5.

Instead of using a headed bolt 17 in the bore 11 of the wheel spindle 9 to move the grinding-wheel-retaining shaft 13, the grinding-wheel-retaining shaft 13 may be screwed directly into a corresponding threaded bore of the wheel spindle 9. In this manner, the grinding-wheel-retaining shaft 13 may be, for example, guided out of the wheel spindle 9 and into the region of the flanged bushing 19, which is illustrated with headed bolt 17. The grinding-wheel-retaining shaft 13 may be provided with a handwheel to rotate the grinding-wheel-retaining shaft 13 in the wheel spindle 9.

Figure 2:
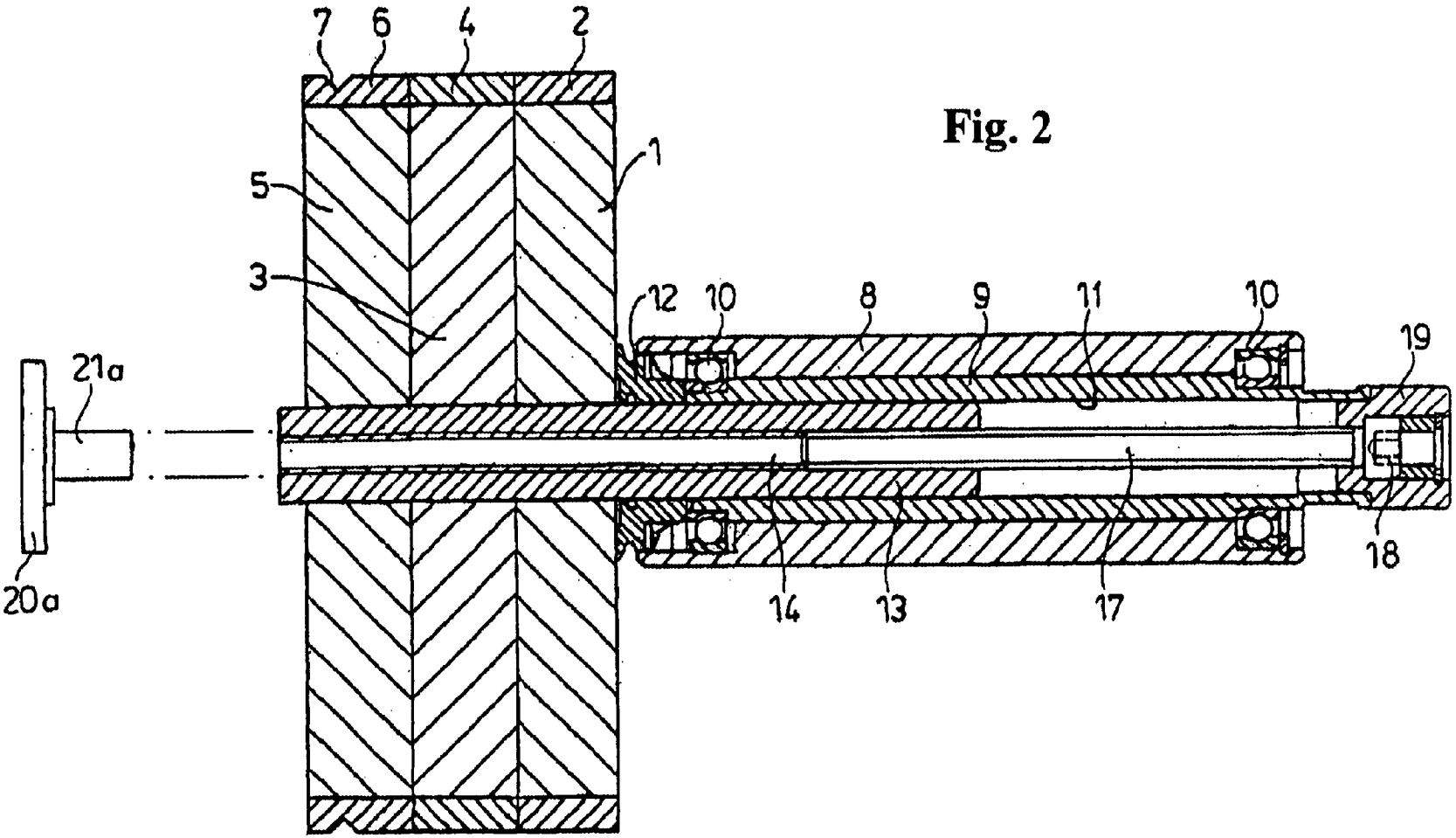
FIG. 2 is a view similar to FIG. 1 of a further embodiment.

As shown in FIG. 2, the retaining disk 20*a* can be mounted by a threaded pin 21*a* that is threaded into the threaded bore 14.

To speed up the exchanging of a group of grinding wheels 1, 3, 5 or a single grinding wheel, the headed bolt 17 may include a threaded spindle, which may be rotated by an electromotive drive. A similar drive may also be provided if the grinding-wheel-retaining shaft 13 is screwed directly into the wheel spindle 9.

Figure 3:
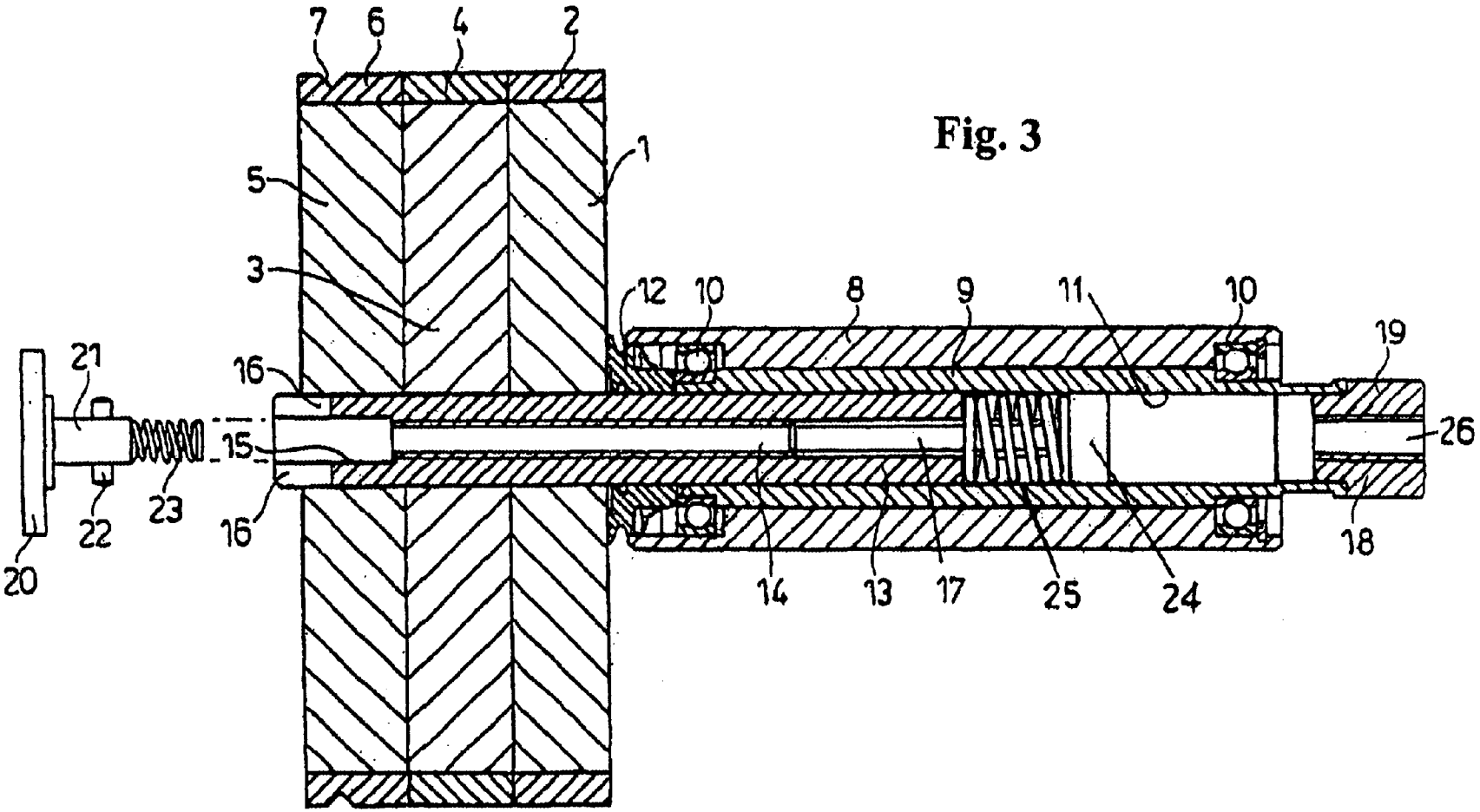
FIG. 3 is a view as in FIG. 1 of another embodiment.

Furthermore, as shown in FIG. 3, a hydraulic or pneumatic piston/cylinder unit 24 may be arranged between the wheel spindle 9 and the grinding-wheel-retaining shaft 13.

The unit 24 has a connection 26 for pressurized fluid. Also, cup springs 25 are arranged between the shaft 13 and the piston head. The unit 24 may permit the quick displacement of the grinding-wheel-retaining shaft 13 in relation to the wheel spindle 9 and may provide the bracing of the grinding wheels 1, 3, 5.

What is claimed is:

1. Apparatus for releasably securing a grinding wheel or a group of grinding wheels in a spectacle-lens edging machine, comprising:

a wheel spindle having an axis and a bore extending along the axis;

a grinding-wheel-retaining shaft arranged with a close fit in the bore of the wheel spindle and being displaceable in the bore along the axis of the wheel spindle, the grinding wheel retaining shaft having a free end toward a grinding wheel;

at least one grinding wheel on the free end of the grinding-wheel-retaining shaft, the at least one grinding wheel having a width along the axis of the wheel spindle, the grinding-wheel-retaining shaft being displaceable in the bore of the wheel spindle by at least the width of the grinding wheel;

a retaining disk releasably secured to the free end of the grinding-wheel-retaining shaft for retaining the at least one grinding wheel; and a clamping arrangement operable to axially release and retract the grinding-wheel-retaining shaft into the bore of the wheel spindle by at least the width of the at least one grinding wheel;

wherein displacement of the grinding-wheel-retaining shaft into the bore of the wheel spindle in one axial direction axially braces the at least one grinding wheel between the wheel spindle and the retaining disk, and in an opposite axial direction releases the retaining disk from the wheel spindle and wherein displacement of the grinding-wheel-retaining shaft into the bore of the wheel spindle in said one axial direction by at least the width of the at least one grinding wheel releases said at least one grinding wheel from the grinding-wheel-retaining shaft.

2. The apparatus of claim 1, wherein the retaining disk is configured to be screwed to the free end of the grinding-wheel-retaining shaft.

3. The apparatus of claim 1, wherein the retaining disk includes an extension to provide a bayonet connection with the free distal end of the grinding-wheel-retaining shaft.

4. The apparatus of claim 1, further comprising a screw connection in the bore between the grinding-wheel-retaining shaft and the wheel spindle, wherein the grinding-wheel-retaining shaft is displaceable along the axis of the wheel spindle via the screw connection.

5. The apparatus of claim 4, wherein the clamping arrangement includes a headed bolt and a flanged bushing to support the headed bolt on the wheel spindle, the grinding-wheel-retaining shaft including a threaded bore to receive the headed bolt.

6. The apparatus of claim 1, wherein the clamping arrangement includes at least one of a hydraulic and pneumatic piston/cylinder unit to displace the grinding-wheel-retaining shaft along the bore of the wheel spindle.

* * * * *